US011698040B1

(12) United States Patent
Arisawa

(10) Patent No.: US 11,698,040 B1
(45) Date of Patent: Jul. 11, 2023

(54) INTERNAL COMBUSTION ENGINE SYSTEM

(71) Applicant: TOYOTA JIDOSHA KABUSHIKI KAISHA, Toyota (JP)

(72) Inventor: Tatsuaki Arisawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/068,802

(22) Filed: Dec. 20, 2022

(30) Foreign Application Priority Data

Mar. 2, 2022 (JP) ..... 2022-031784

(51) Int. Cl.

| | |
|---|---|
| ***F02D 13/02*** | (2006.01) |
| ***F02D 41/06*** | (2006.01) |
| ***F02D 19/08*** | (2006.01) |
| *F01L 9/40* | (2021.01) |
| *F02D 1/16* | (2006.01) |

(52) U.S. Cl.
CPC ..... *F02D 41/068* (2013.01); *F02D 13/0265* (2013.01); *F02D 19/084* (2013.01); *F02D 19/085* (2013.01); *F01L 2009/4084* (2021.01); *F01L 2800/02* (2013.01); *F02D 2001/167* (2013.01); *F02D 2200/021* (2013.01); *F02D 2200/022* (2013.01)

(58) Field of Classification Search
CPC ..... F01L 2009/4084; F01L 2800/02; F02D 13/0261; F02D 13/0265; F02D 19/084; F02D 41/068; F02D 2001/167; F02D 2200/022
USPC ..... 123/431, 435; 701/105
See application file for complete search history.

(56) References Cited

U.S. PATENT DOCUMENTS 5,626,109 A * 5/1997 Yasumura ..... F02D 13/0215 123/90.31
2018/0066599 A1* 3/2018 Narahara ..... F02D 41/3094

FOREIGN PATENT DOCUMENTS

JP 2013-224623 A 10/2013

* cited by examiner

*Primary Examiner* — Erick R Solis
(74) *Attorney, Agent, or Firm* — Oblon, McClelland, Maier & Neustadt, L.L.P.

(57) ABSTRACT

An internal combustion engine system includes an internal combustion engine including a cylinder, an intake valve and an exhaust valve, a cylinder injection valve, and a variable valve drive mechanism, and a control device that controls the cylinder injection valve and the variable valve drive mechanism. The control device includes a calculation unit that calculates a first crank angle section where a temperature of the cylinder is equal to or higher than a boiling point of the fuel in a compression stroke before completion of warming-up of the internal combustion engine and a second crank angle section where the temperature of the cylinder is equal to or higher than the boiling point of the fuel in the valve closed period, and an injection controller that executes fuel injection in the first and second crank angle sections by the cylinder injection valve.

12 Claims, 10 Drawing Sheets

INTERNAL COMBUSTION ENGINE SYSTEM

CROSS-REFERENCE TO RELATED APPLICATION

This application claims priority to Japanese Patent Application No. 2022-031784 filed on Mar. 2, 2022, incorporated herein by reference in its entirety.

BACKGROUND

1. Technical Field

The present disclosure relates to an internal combustion engine system.

2. Description of Related Art

An internal combustion engine that can use fuel containing alcohol is known. Before completion of warming-up of such an internal combustion engine, a temperature of a cylinder may be low, the vaporizability of fuel injected into the cylinder may decrease to make combustion unstable. Accordingly, to promote vaporization of fuel injected into the cylinder, cylinder injection is executed in a second half of a compression stroke in which gas is adiabatically compressed in the cylinder and a cylinder temperature increases (for example, see Japanese Unexamined Patent Application Publication No. 2013-224623 (JP 2013-224623 A)).

SUMMARY

There is a need for executing cylinder injection even in other strokes, in addition to the second half of the compression stroke described above, depending on a requested cylinder injection amount. In this case, vaporization of fuel injected into the cylinder may not be sufficiently promoted in other strokes, and combustion may be made unstable.

The disclosure provides an internal combustion engine system in which combustion is stable.

An aspect of the disclosure relates to an internal combustion engine system including an internal combustion engine and a control device. The internal combustion engine includes a cylinder, an intake valve and an exhaust valve, a cylinder injection valve, and a variable valve drive mechanism. The intake valve and the exhaust valve open and close the cylinder. The cylinder injection valve directly injects fuel containing alcohol into the cylinder. The variable valve drive mechanism forms a valve closed period from when the exhaust valve is closed to when the intake valve is opened. The control device controls the cylinder injection valve and the variable valve drive mechanism. The control device includes a calculation unit and an injection controller. The calculation unit calculates a first crank angle section where a temperature of the cylinder is equal to or higher than a boiling point of the fuel in a compression stroke and a second crank angle section where the temperature of the cylinder is equal to or higher than the boiling point of the fuel in the valve closed period, before completion of warming-up of the internal combustion engine. The injection controller executes fuel injection in the first and second crank angle sections by the cylinder injection valve.

The control device may include a first determination unit that determines whether or not the cylinder injection valve is able to inject a requested cylinder injection amount in the first crank angle section. The injection controller may execute the fuel injection in the first crank angle section by the cylinder injection valve when affirmative determination is made in the first determination unit and may execute the fuel injection in the first and second crank angle sections by the cylinder injection valve when negative determination is made in the first determination unit.

The control device may include a second determination unit that determines whether or not the cylinder injection valve is able to inject the requested cylinder injection amount in the first and second crank angle sections. The injection controller may execute the fuel injection in the first and second crank angle sections by the cylinder injection valve when negative determination is made in the first determination unit and affirmative determination is made in the second determination unit and may execute the fuel injection in the first and second crank angle sections and an intake stroke by the cylinder injection valve when negative determination is made in the first and second determination units.

The control device may further include an alcohol concentration acquisition unit that acquires an alcohol concentration in the fuel. The calculation unit may calculate a start crank angle of the first crank angle section to be more retarded as the alcohol concentration is higher.

The calculation unit may calculate a start crank angle of the second crank angle section to be more retarded as the alcohol concentration is higher.

The control device may further include a temperature acquisition unit that acquires a temperature of the internal combustion engine. The calculation unit may calculate the first crank angle section to be shorter as the temperature is lower.

The calculation unit may calculate the second crank angle section to be shorter as the temperature is lower.

The control device may further include a rotation speed acquisition unit that acquires a rotation speed of the internal combustion engine. The calculation unit may calculate the first crank angle section to be shorter as the rotation speed is lower.

The calculation unit may calculate the second crank angle section to be shorter as the rotation speed is lower.

The valve closed period may include an intake top dead center.

The calculation unit may set an end time of the first crank angle section to be more advanced than a compression top dead center.

The calculation unit may set an end time of the second crank angle section to be more advanced than an intake top dead center.

According to the aspect of the disclosure, an internal combustion engine system in which combustion is stable can be provided.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Schematic Configuration of Internal Combustion Engine System

Figure 1:
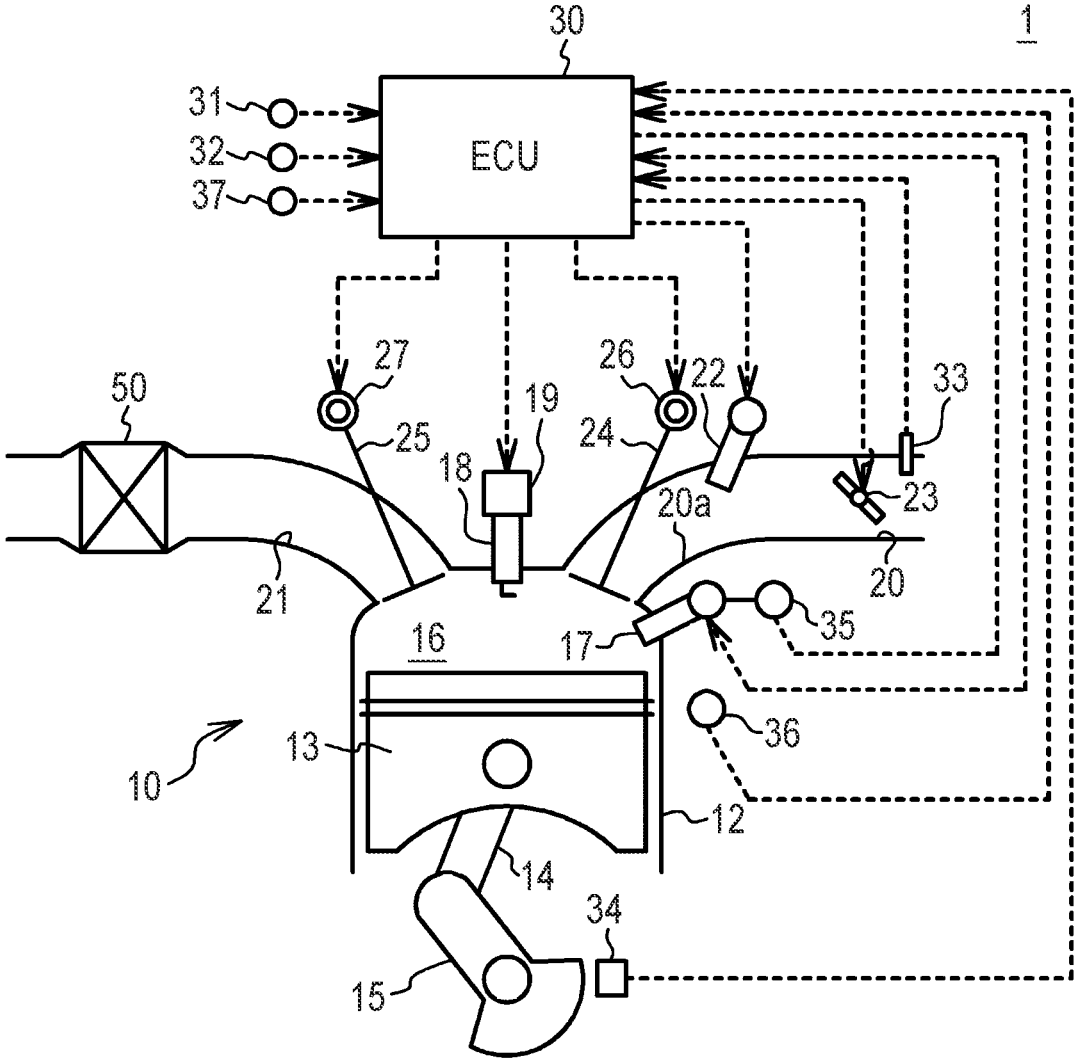
FIG. 1 is a schematic configuration diagram of an internal combustion engine system.

FIG. 1 is a schematic configuration diagram of an internal combustion engine system 1. The internal combustion engine system 1 includes an engine 10 and an electronic control unit (ECU) 30. The engine 10 is an internal combustion engine that can use fuel in which alcohol fuel and gasoline fuel are mixed. Although the engine 10 is mounted in, for example, an engine vehicle, the disclosure is not limited thereto, and the engine 10 may be mounted in a hybrid electric vehicle (HEV). A piston 13 is provided in each cylinder 12 of the engine 10. The piston 13 is connected to a crankshaft 15 that is an output shaft of the engine 10, through a connecting rod 14. A reciprocating motion of the piston 13 is converted to a rotational motion of the crankshaft 15 by the connecting rod 14.

A combustion chamber 16 is formed above the piston 13 in each cylinder 12, and an ignition plug 18 that ignites an air-fuel mixture of fuel and air is attached to the combustion chamber 16. An ignition timing to the air-fuel mixture by the ignition plug 18 is adjusted by an igniter 19 provided above the ignition plug 18.

In the cylinder 12, an intake valve 24 and an exhaust valve 25 that open and close the cylinder 12 are provided. The intake valve 24 is opened to communicate the combustion chamber 16 with an intake passage 20, and the intake valve 24 is closed to cut off the communication of the combustion chamber 16 and an intake passage 20. The exhaust valve 25 is opened to communicate the combustion chamber 16 with an exhaust passage 21, and the exhaust valve 25 is closed to cut off the communication of the combustion chamber 16 and the exhaust passage 21.

The intake valve 24 is provided with an intake-side variable valve drive mechanism (hereinafter, referred to as an intake VVT) 26 that changes an opening and closing time of the intake valve 24. Similarly, the exhaust valve 25 is provided with an exhaust-side variable valve drive mechanism (hereinafter, referred to as an exhaust VVT) 27 that changes an opening and closing time of the exhaust valve 25. The intake VVT 26 changes the opening and closing time of the intake valve 24 to be advanced or retarded by changing a phase of an intake-side drive cam that opens and closes the intake valve 24 provided in an intake-side camshaft, with respect to the intake-side camshaft. Similarly, the exhaust VVT 27 changes the opening and closing time of the exhaust valve 25 to be advanced or retarded by changing a phase of an exhaust-side drive cam that opens and closes the exhaust valve 25 provided in an exhaust-side camshaft, with respect to the exhaust-side camshaft. The phase of the drive cam with respect to the camshaft is switched depending on hydraulic pressure that is adjusted by an oil control valve. Instead of the hydraulic intake VVT 26 or exhaust VVT 27, an electric variable valve drive mechanism may be employed.

The intake passage 20 is provided with a throttle valve 23 that adjusts an amount of air to be introduced into the combustion chamber 16. The exhaust passage 21 is provided with a catalyst 50 that exhibits the maximum exhaust gas control ability when an air-fuel ratio of the air-fuel mixture is a stoichiometric air-fuel ratio. The catalyst 50 is a three-way catalyst having an oxygen storage ability of storing oxygen in exhaust gas leaner than the stoichiometric air-fuel ratio and of releasing stored oxygen to exhaust gas richer than the stoichiometric air-fuel ratio.

Each intake port 20*a* that configures a part of the intake passage 20 is provided with a port injection valve 22 that injects fuel into the intake port 20*a* for each cylinder 12. The engine 10 is provided with a cylinder injection valve 17 that directly injects fuel into each combustion chamber 16.

The ECU 30 is an electronic control unit that performs control regarding the engine 10. The ECU 30 is configured centering on a computer including a central processing unit (CPU) and a volatile or nonvolatile memory, such as a random access memory (RAM) or a read only memory (ROM). The ECU 30 realizes various kinds of control processing regarding the engine 10 by executing a program installed on the memory, on the CPU. Although details will be described below, various sensors are connected to the ECU 30. The ECU 30 is an example of a control device, and in detail, functionally realizes a calculation unit, a first determination unit, a second determination unit, a valve drive controller, an injection controller, an alcohol concentration acquisition unit, a temperature acquisition unit, and a rotation speed acquisition unit described below.

An ignition switch 31, an accelerator operation amount sensor 32, an air flowmeter 33, a crank angle sensor 34, a fuel pressure sensor 35, a coolant temperature sensor 36, and an alcohol concentration sensor 37 are connected to the ECU 30, and output signals from various sensors are input to the ECU 30. The ignition switch 31 detects on and off states of ignition. The accelerator operation amount sensor 32 detects an accelerator operation amount. The air flowmeter 33 detects an intake air amount. The crank angle sensor 34 detects a rotation angle of the crankshaft 15. The fuel pressure sensor 35 detects pressure of fuel in a high pressure delivery pipe that stores fuel supplied to the cylinder injection valve 17 under pressure. The coolant temperature sensor 36 detects a temperature of a coolant that cools the engine 10. The alcohol concentration sensor 37 is provided, for example, in a fuel tank or on a conveying route of fuel and detects an alcohol concentration in fuel.

The ECU 30 calculates an engine rotation speed based on a detection value of the crank angle sensor 34 and detects an engine load based on the engine rotation speed and the intake air amount. The ECU 30 calculates a target rotation speed and a target load based on the accelerator operation amount and controls a fuel injection amount or the intake air amount and an ignition time such that the engine rotation speed and the load are the target rotation speed and the target load, respectively. The ECU 30 controls a cylinder injection ratio that is a ratio of an injection amount from the cylinder injection valve 17 to a total fuel injection amount and a port injection ratio that is a ratio of an injection amount from the port injection valve 22 to the total fuel injection amount, depending on an operation state of the engine 10. The ECU 30 controls the opening and closing time of the intake valve 24 and the exhaust valve 25 by controlling the intake VVT 26 and the exhaust VVT 27 depending on the operation state of the engine 10.

As described above, the engine 10 uses fuel containing alcohol. Such fuel has a boiling point that is higher as the alcohol concentration is higher, and is difficult to be vaporized. In particular, before completion of warming-up of the engine 10, since a temperature (hereinafter, referred to as a cylinder temperature) of the cylinder 12 is low, vaporization of fuel injected from the cylinder injection valve 17 may be damaged, and combustion may be made unstable. For this reason, in the ECU 30 of the example, when a predetermined condition is established before completion of warming-up of the engine 10, the following fuel injection control is executed.

Fuel Injection Control

Figure 2:
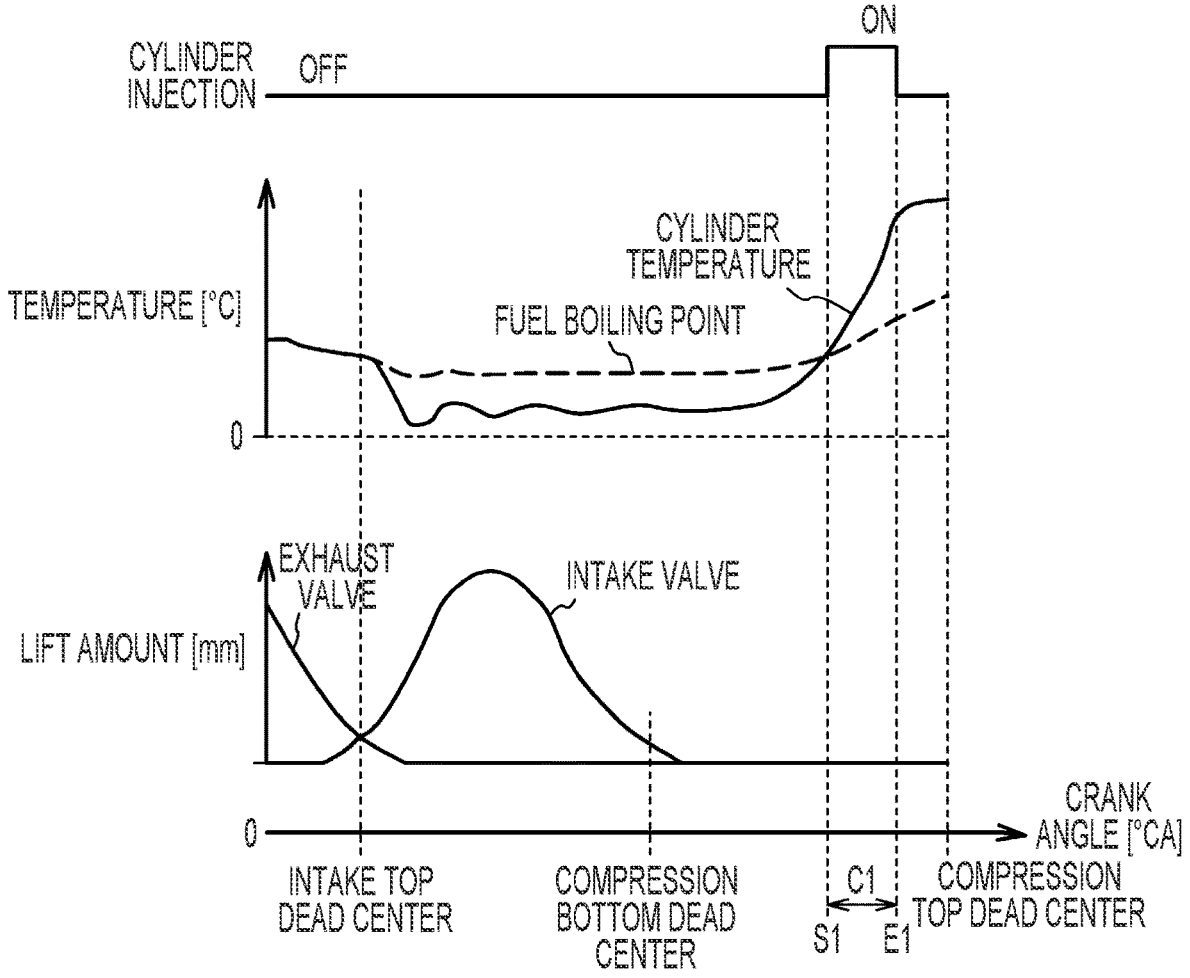
FIG. 2 is an example of a timing chart of fuel injection control.
Figure 3:
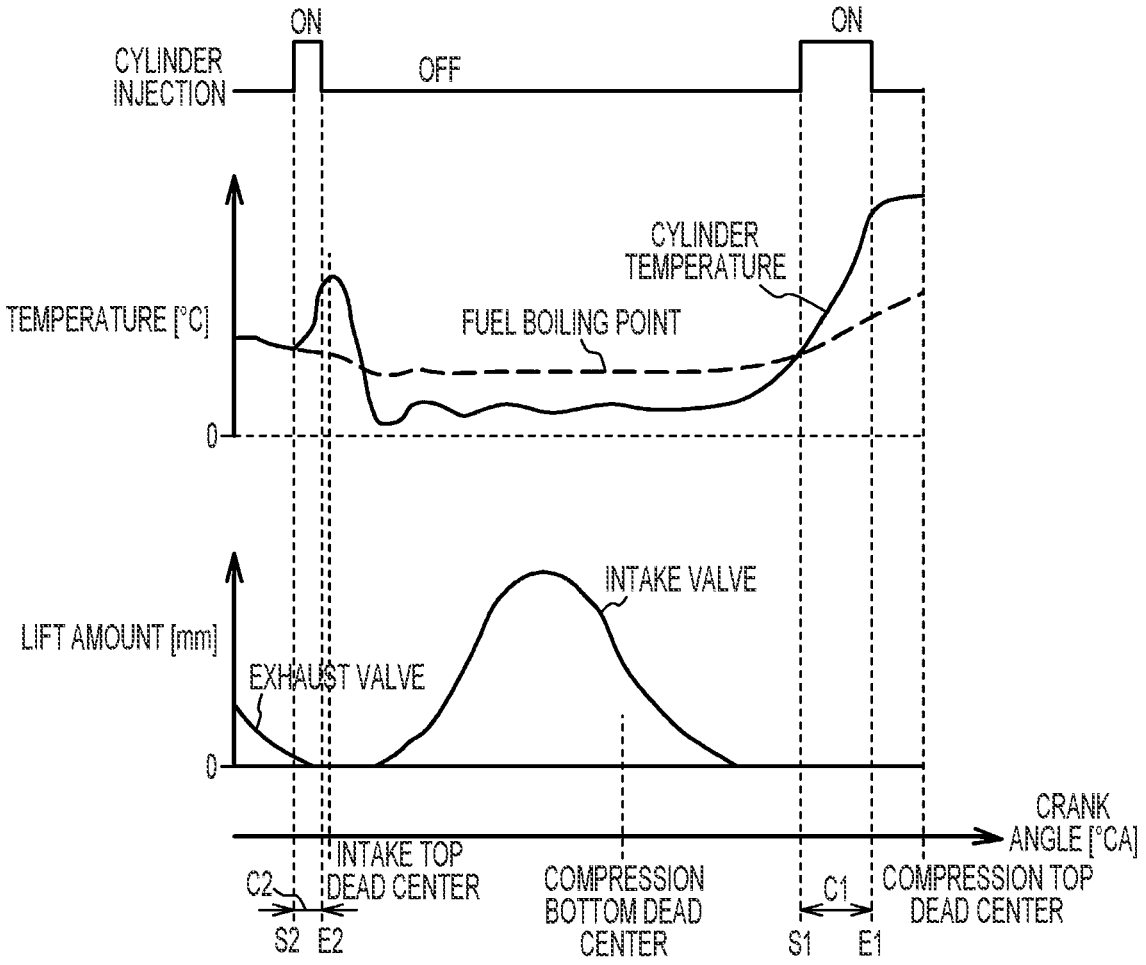
FIG. 3 is an example of a timing chart of the fuel injection control.
Figure 4:
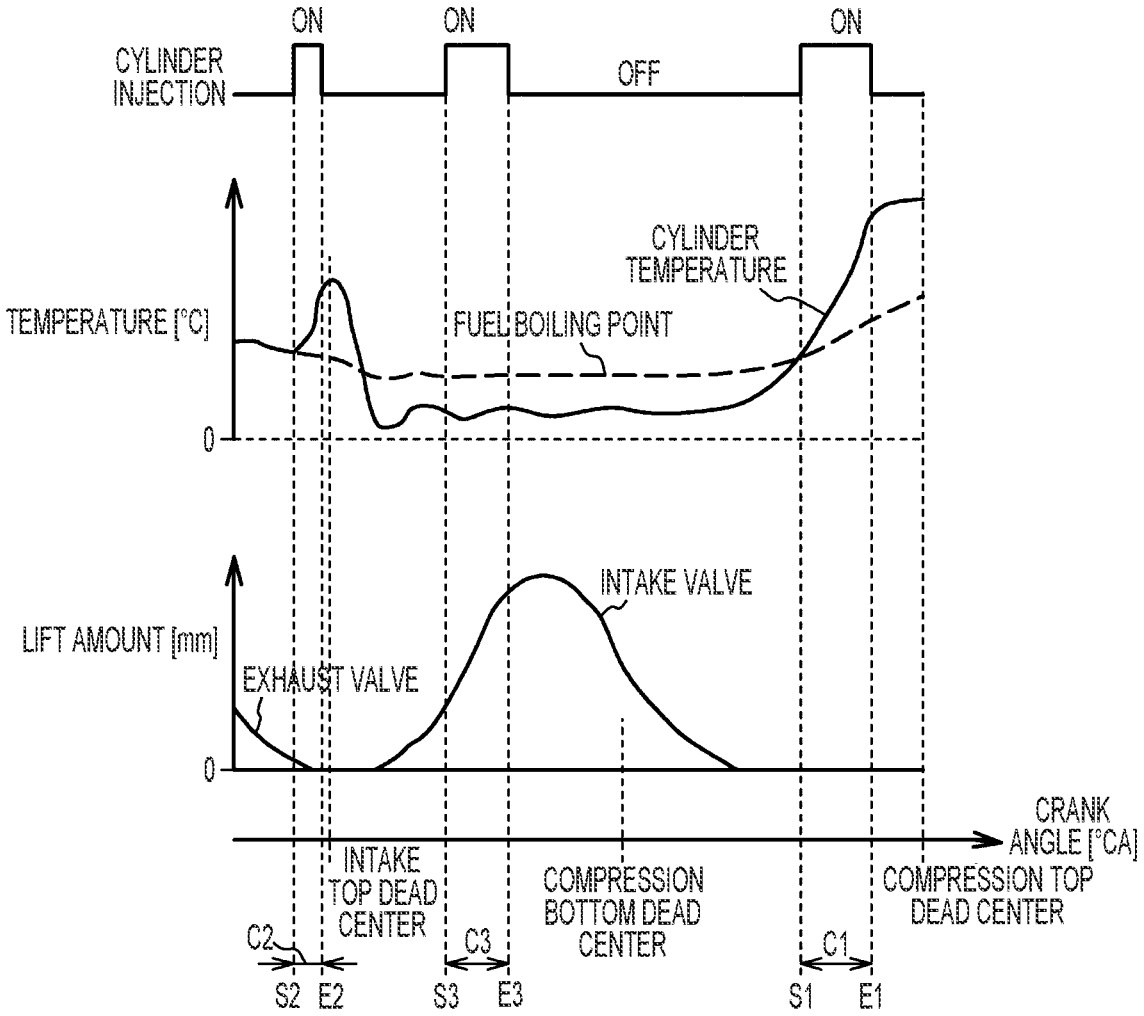
FIG. 4 is an example of a timing chart of the fuel injection control.

FIGS. 2 to 4 are examples of a timing chart of the fuel injection control. FIGS. 2 to 4 show a state of cylinder injection, the fuel boiling point [° C.], the cylinder temperature [° C.], and a lift amount [mm] of each of the intake valve 24 and the exhaust valve 25. The horizontal axis in FIGS. 2 to 4 indicates a crank angle [° CA]. In FIGS. 2 to 4, a section from an intake top dead center to a compression bottom dead center corresponds to an intake stroke, and a section from the compression bottom dead center to a compression top dead center corresponds to a compression stroke.

First, FIG. 2 will be described. In FIG. 2, a valve opening time of the intake valve 24 is set to be more advanced than the intake top dead center, and a valve closing time of the exhaust valve 25 is set to be more retarded than the intake top dead center. That is, an overlap period during which both the intake valve 24 and the exhaust valve 25 are brought into a valve open state is secured.

As shown in FIG. 2, the cylinder temperature falls below the fuel boiling point in the intake stroke or in a first half of the compression stroke, and increases over the fuel boiling point in a second half of the compression stroke. The reason is because, in the intake stroke, the intake valve 24 is in the valve open state and the piston 13 moves downward, such that the volume of the combustion chamber 16 increases with introduction of fresh air into the cylinder 12. The reason is also because the volume of the combustion chamber 16 is comparatively large in the first half of the compression stroke, the volume of the combustion chamber 16 decreases in the second half of the compression stroke, and gas in the cylinder 12 is adiabatically compressed with upward movement of the piston 13. In an example of FIG. 2, in a first crank angle section C1 from when the cylinder temperature in the second half of the compression stroke is equal to or higher than the fuel boiling point, to the compression top dead center, cylinder injection is executed. With this, vaporization of fuel is promoted in the first crank angle section C1. FIGS. 2 to 4 show a start crank angle S1 and an end crank angle E1 of cylinder injection in the second half of the compression stroke.

In FIG. 3, the valve opening time of the intake valve 24 is set to be more retarded than the intake top dead center, and the valve closing time of the exhaust valve 25 is set to be more advanced than the intake top dead center. That is, a valve closed period during which both the intake valve 24 and the exhaust valve 25 are brought into the valve closed state is secured. In the valve closed period, the cylinder temperature increases over the fuel boiling point. The reason is because gas in the closed cylinder 12 is adiabatically compressed with upward movement of the piston 13. In an example of FIG. 3, cylinder injection is executed in the first crank angle section C1 as in the example of FIG. 2, and cylinder injection is executed even in a second crank angle section C2 where the cylinder temperature is equal to or higher than the fuel boiling point in the valve closed period. With this, vaporization of fuel is promoted in the second crank angle section C2. FIG. 3 shows a start crank angle S2 and an end crank angle E2 of cylinder injection in the valve closed period. Although details will be described below, FIG. 3 shows the time of cylinder injection when a requested cylinder injection amount is greater than in the example of FIG. 2.

In FIG. 4, as in FIG. 3, the valve closed period is secured. In FIG. 4, cylinder injection is executed in the first crank angle section C1 and the second crank angle section C2 as in the example of FIG. 3, and cylinder injection is executed in a third crank angle section C3 in the intake stroke. Since fresh air is being introduced into the cylinder 12 in the intake stroke where the intake valve 24 is opened, fuel is stirred by fresh air introduced into the cylinder 12, whereby fuel can be restrained from being stuck to a wall surface in the combustion chamber 16, and vaporization of fuel may be promoted. FIG. 4 shows a start crank angle S3 and an end crank angle E3 of cylinder injection in the intake stroke. Although details will be described below, FIG. 4 shows the time of cylinder injection when the requested cylinder injection amount is greater than in the example of FIG. 3.

Figure 5:
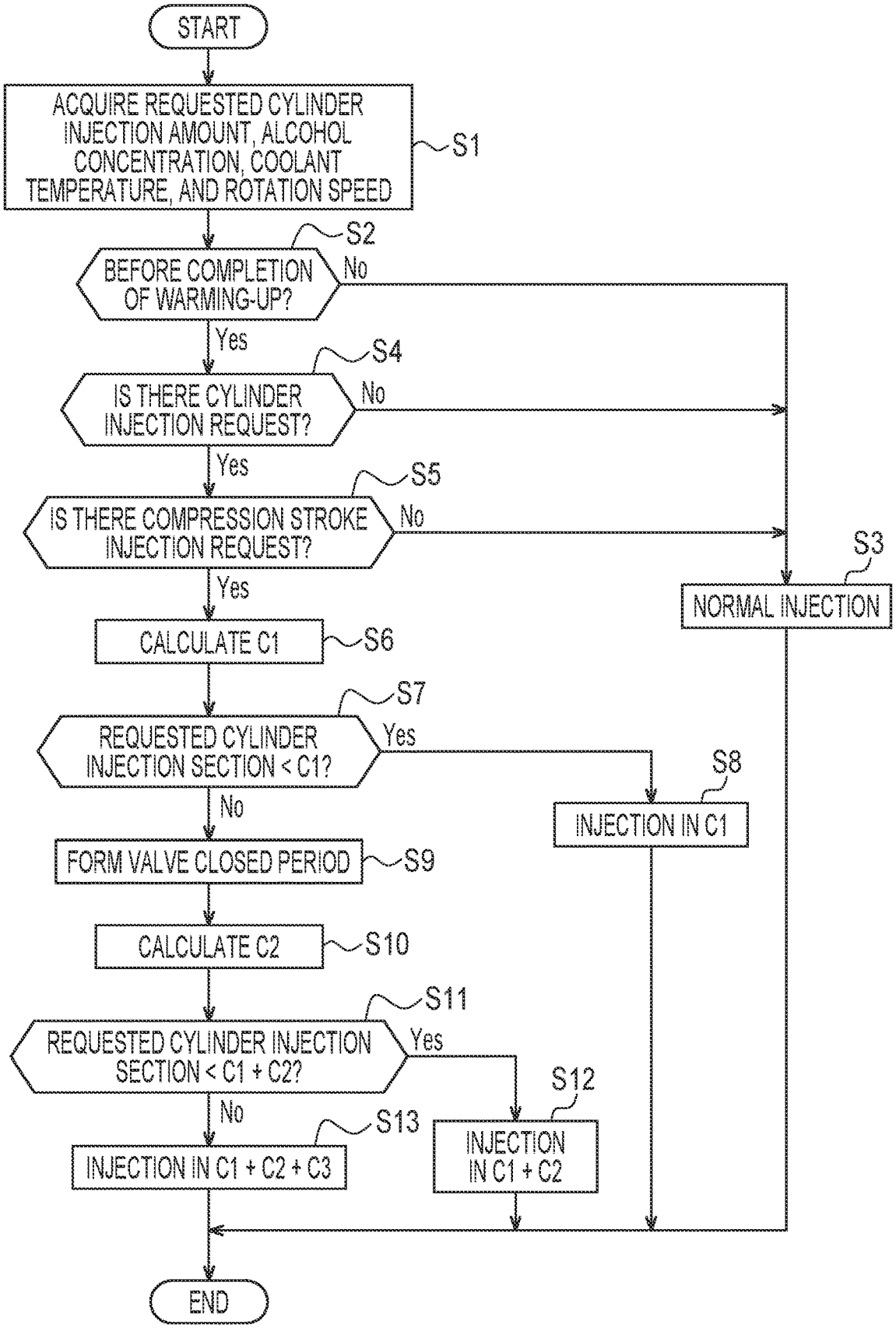
FIG. 5 is an example of a flowchart showing fuel injection control that is executed by an ECU.

FIG. 5 is an example of a flowchart showing fuel injection control that is executed by the ECU 30. The control is repeatedly executed in a state of ignition-on. First, the ECU 30 acquires the requested cylinder injection amount, the alcohol concentration in fuel, the temperature of the coolant, and the engine rotation speed (Step S1). The requested cylinder injection amount is calculated by multiplying a requested total fuel injection amount by the cylinder injection ratio. The alcohol concentration in fuel is detected by the alcohol concentration sensor 37. The temperature of the coolant is detected by the coolant temperature sensor 36. The engine rotation speed is detected by the crank angle sensor 34. Step S1 is an example of processing that is executed by the alcohol concentration acquisition unit, the temperature acquisition unit, and the rotation speed acquisition unit.

Next, the ECU 30 determines whether or not warming-up of the engine 10 is not completed, for example, based on the temperature of the coolant (Step S2). When determination is made to be No in Step S2, the ECU 30 executes fuel injection at a predetermined timing after warming-up completion (Step S3).

When determination is made to be Yes in Step S2, the ECU 30 determines whether or not there is a cylinder injection request (Step S4). In detail, the ECU 30 determines whether or not there is the cylinder injection request when the cylinder injection ratio is other than 0%. When determination is made to be No in Step S4, the ECU 30 executes fuel injection with the port injection valve 22 at a predetermined timing before warming-up completion (Step S3).

Figure 6:
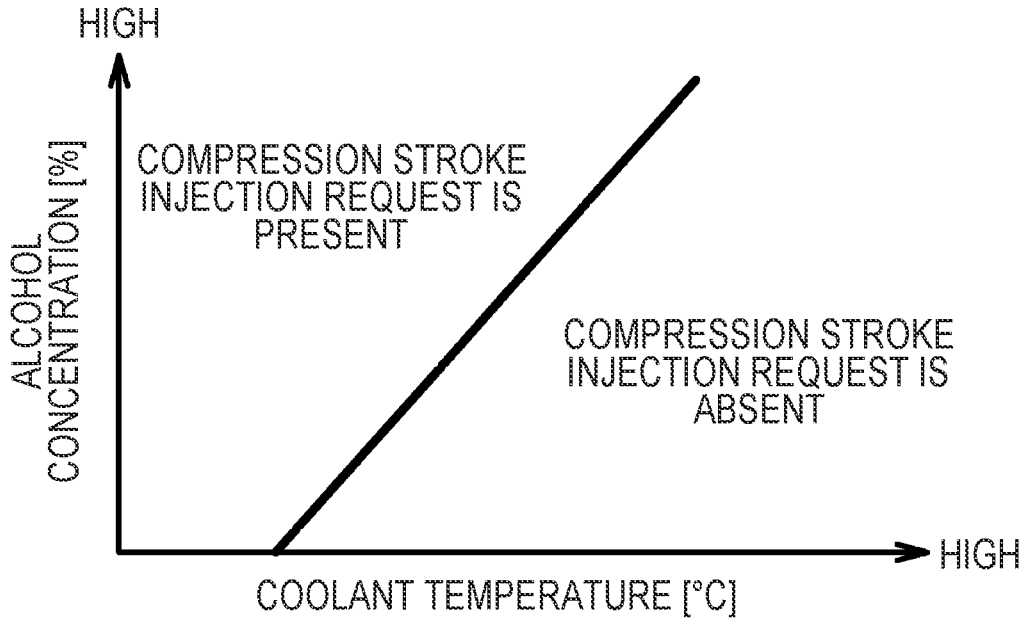
FIG. 6 is an example of a map in which the presence or absence of a compression stroke injection request is defined based on an alcohol concentration and a coolant temperature.

When determination is made to be Yes in Step S4, the ECU 30 determines whether or not there is a compression stroke injection request (Step S5). Specifically, the ECU 30 determines whether or not there is the compression stroke injection request, with reference to a map of FIG. 6. FIG. 6 is an example of a map in which the presence or absence of the compression stroke injection request is defined based on the alcohol concentration and the coolant temperature. The vertical axis indicates the alcohol concentration [%], and the horizontal axis indicates the coolant temperature [° C.]. When the temperature of the coolant is low and the alcohol concentration is high, since fuel is difficult to be vaporized, compression stroke injection is requested. When the temperature of the coolant is high and the alcohol concentration is low, since fuel is easily vaporized, compression stroke injection is not requested. When the alcohol concentration is constant, and when the temperature of the coolant is low, compression stroke injection is requested, and when the temperature of the coolant is high, compression stroke injection is not requested. The reason is because, in a case where the temperature of the coolant is low even though the alcohol concentration is constant, fuel is difficult to be vaporized. When the temperature of the coolant is constant, and when the alcohol concentration is high, compression stroke injection is requested, and when the alcohol concentration is low, compression stroke injection is not requested. This is because, in a case where the alcohol concentration is high even though the temperature of the coolant is constant, fuel is difficult to be vaporized. When determination is made to be No in Step S5, Step S3 is executed.

When determination is made to be Yes in Step S5, the ECU 30 calculates the first crank angle section C1 (Step S6). The first crank angle section C1 is a difference between the end crank angle E1 and the start crank angle S1. Here, the end crank angle E1 is a fixed value that is set to be more advanced than the compression top dead center. With this, an amount of fuel stuck to a top surface of the piston 13 can be suppressed and an injection amount contributing to combustion can be secured to stabilize combustion. The start crank angle S1 is a variable value that is set based on the alcohol concentration, the coolant temperature, and the engine rotation speed. Step S6 is an example of processing that is executed by the calculation unit. Specifically, the ECU 30 sets the start crank angle S1 with reference to maps of FIGS. 7A and 7B.

Figure 7A:
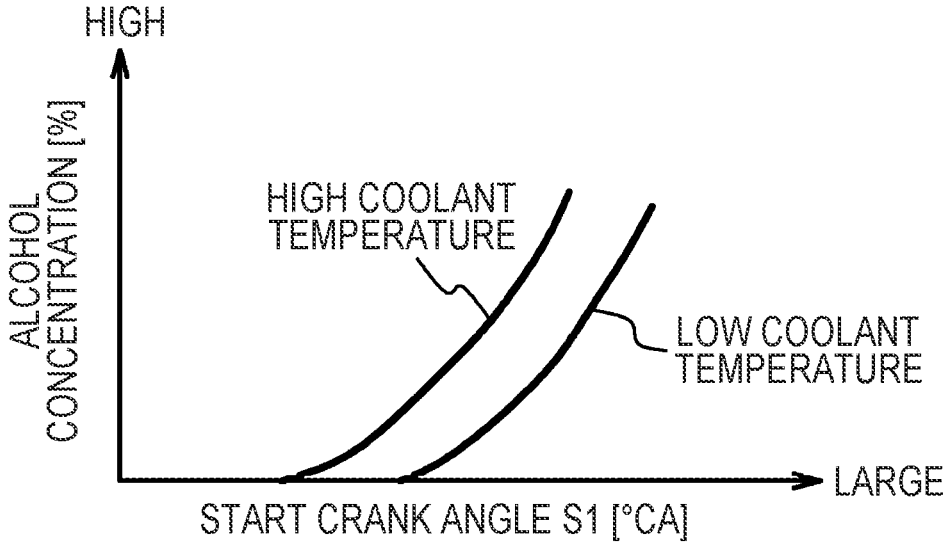
FIG. 7A is an example of a map in which a start crank angle S1 that is set depending on the alcohol concentration, the coolant temperature, and an engine rotation speed is defined.
Figure 7B:
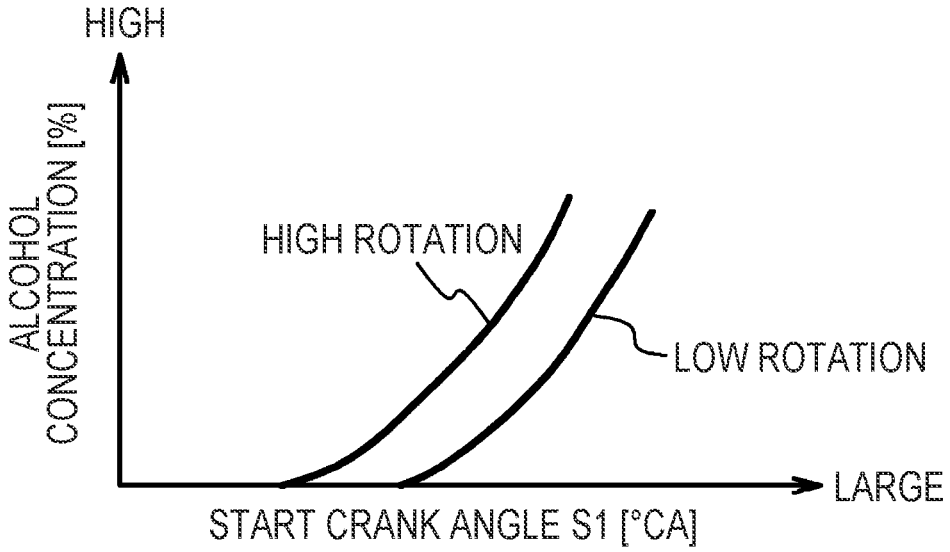
FIG. 7B is an example of a map in which the start crank angle S1 that is set depending on the alcohol concentration, the coolant temperature, and the engine rotation speed is defined.

FIGS. 7A and 7B are an example of a map in which the start crank angle S1 that is set depending on the alcohol concentration, the coolant temperature, and the engine rotation speed is defined. The vertical axis indicates the alcohol concentration [%], and the horizontal axis indicates the start crank angle S1 [° CA]. FIG. 7A shows a case where the temperature of the coolant is high and a case where the temperature of the coolant is low, and FIG. 7B shows a case where the engine rotation speed is high and a case where the engine rotation speed is low. As shown in FIGS. 7A and 7B, as the alcohol concentration is higher, as the temperature of the coolant is lower, and as the engine rotation speed is lower, the start crank angle S1 is set to be more retarded.

Figure 8A:
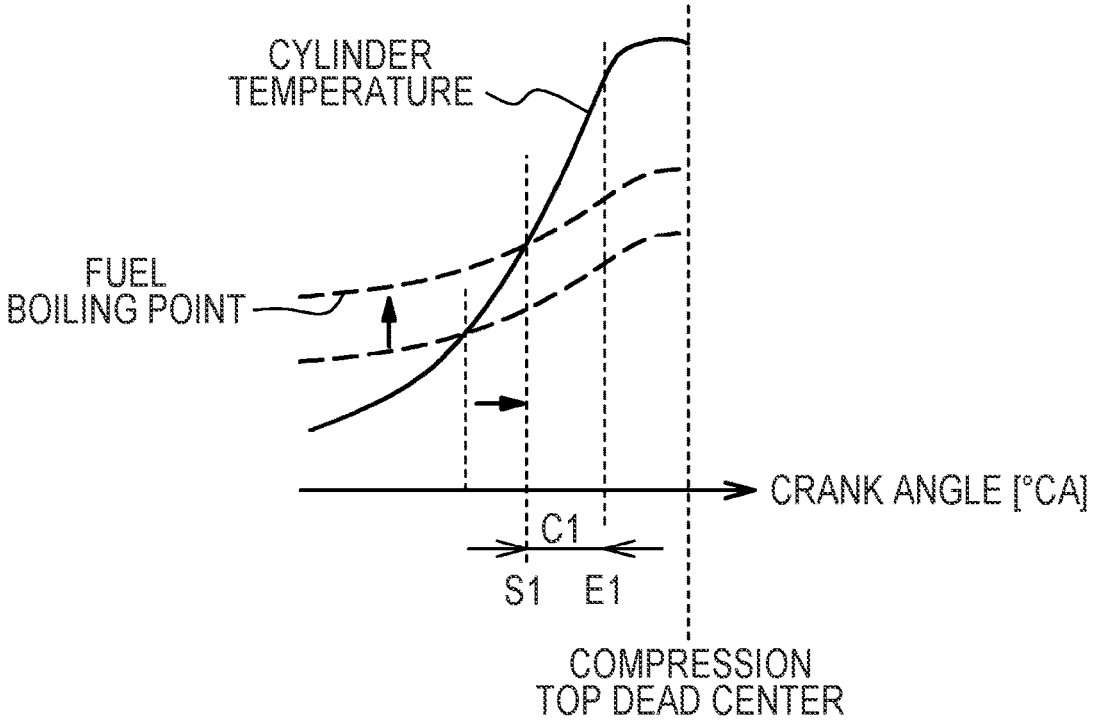
FIG. 8A is an illustrative view of change of the start crank angle S1 when the alcohol concentration is high.
Figure 8B:
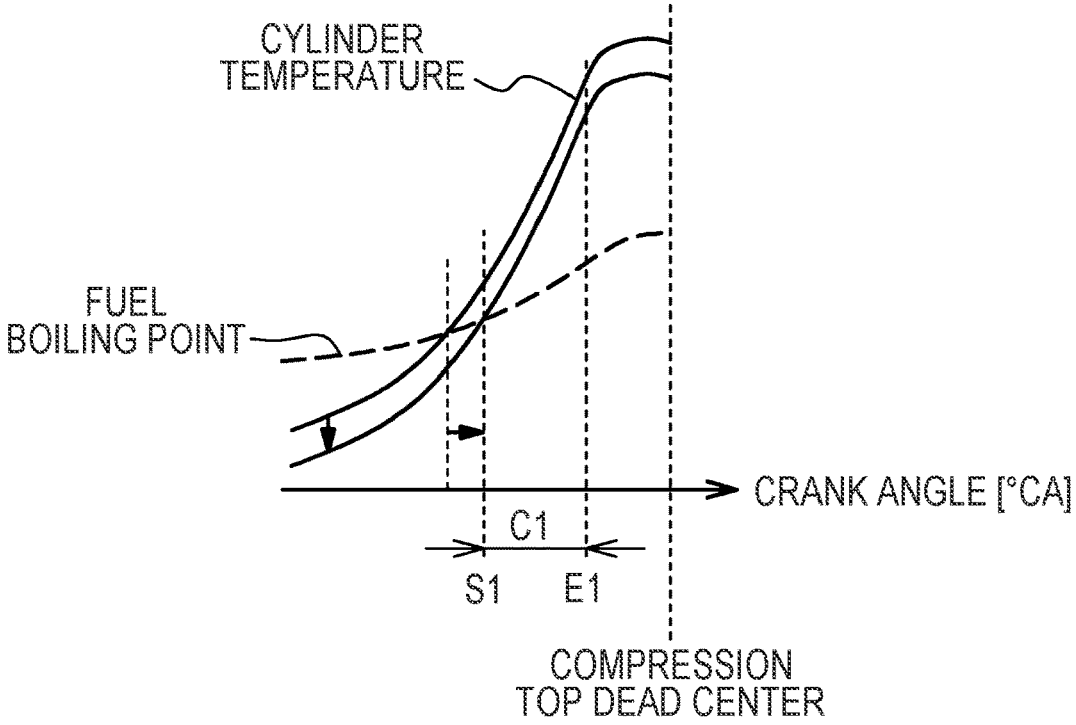
FIG. 8B is an illustrative view of change of the start crank angle S1 when the coolant temperature is low.

FIG. 8A is an illustrative view of change of the start crank angle S1 when the alcohol concentration is high. As the alcohol concentration in fuel is higher, the fuel boiling point is higher. For this reason, as shown in FIG. 8A, a timing at which the cylinder temperature exceeds the fuel boiling point is shifted to be retarded. FIG. 8B is an illustrative view of change of the start crank angle S1 when the temperature of the coolant is lower. As the temperature of the coolant is lower, the cylinder temperature is lower. For this reason, as shown in FIG. 8B, a timing at which the cylinder temperature exceeds the fuel boiling point is shifted to be retarded. When the engine rotation speed is low, since an intake air amount introduced into the cylinder 12 also decreases, as the engine rotation speed is lower, the cylinder temperature is also lower. In this case, as shown in FIG. 8B, the reason is because the timing at which the cylinder temperature exceeds the fuel boiling point is shifted to be retarded. From the above description, as the alcohol concentration is higher, as the coolant temperature is lower, and as the engine rotation speed is lower, the start crank angle S1 is calculated to be retarded. When cylinder injection is executed solely in the first crank angle section C1, as the alcohol concentration is lower, the requested cylinder injection amount is smaller. For this reason, although it does not mean that, as the alcohol concentration is higher, the first crank angle section C1 is always calculated to be shorter, as the coolant temperature is lower and as the engine rotation speed is lower, the first crank angle section C1 is calculated to be shorter.

In the maps of FIGS. 7A and 7B, although the start crank angle S1 changes in a curved shape with respect to the alcohol concentration, the disclosure is not limited thereto, and the start crank angle S1 may change in a linear shape or a stepwise shape. The setting method of the start crank angle S1 described above is not limited as using the map described above, and the start crank angle S1 may be set based on an arithmetic expression with the alcohol concentration, the coolant temperature, and the engine rotation speed as arguments.

Next, the ECU 30 determines whether or not a requested cylinder injection section is less than the first crank angle section C1 (Step S7). The requested cylinder injection section is calculated based on the requested cylinder injection amount and fuel pressure detected by the fuel pressure sensor 35. The requested cylinder injection section is more prolonged as the requested cylinder injection amount is greater and as the fuel pressure is lower. Step S7 is an example of processing that is executed by the first determination unit. When determination is made to be Yes in Step S7, the ECU 30 executes cylinder injection in the first crank angle section C1 (Step S8). Step S8 is an example of processing that is executed by the injection controller.

When determination is made to be No in Step S7, the ECU 30 performs control such that the intake VVT 26 and the exhaust VVT 27 advance the valve closing time of the exhaust valve 25 and retard the valve opening time of the intake valve 24 to form a predetermined valve closed period (Step S9).

Next, the ECU 30 calculates the second crank angle section C2 (Step S10). The second crank angle section C2 is a difference between the end crank angle E2 and the start crank angle S2. Here, the end crank angle E2 is a fixed value set to be more advanced than the intake top dead center. With this, an amount of fuel stuck to a top surface of the piston 13 can be suppressed and an injection amount contributing to combustion can be secured to stabilize combustion. The start crank angle S2 is a variable value that is set based on the alcohol concentration, the coolant temperature, and the engine rotation speed, like the start crank angle S1. Step S10 is an example of processing that is executed by the calculation unit. Specifically, the ECU 30 sets the start crank angle S2 with reference to maps of FIGS. 9A and 9B.

Figure 9A:
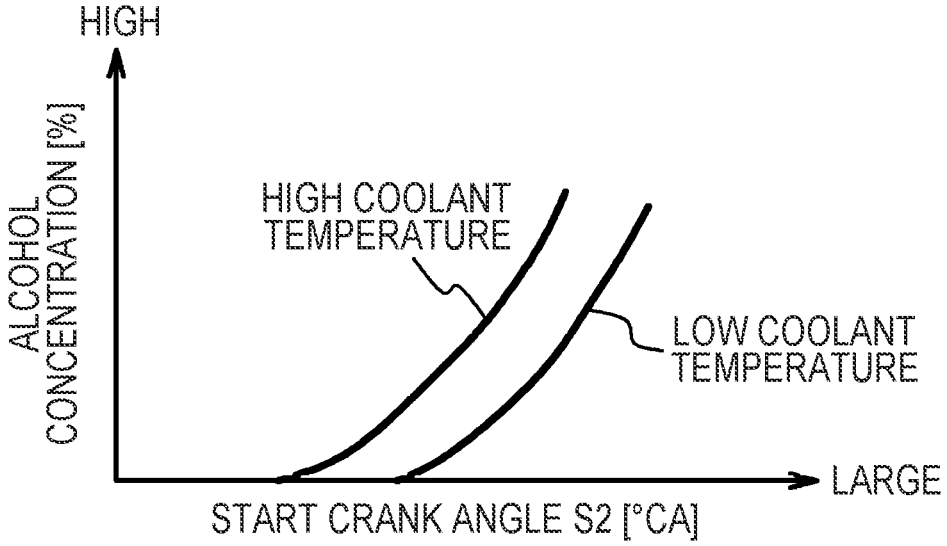
FIG. 9A is an example of a map in which a start crank angle S2 that is set depending on the alcohol concentration, the coolant temperature, and the engine rotation speed is defined.
Figure 9B:
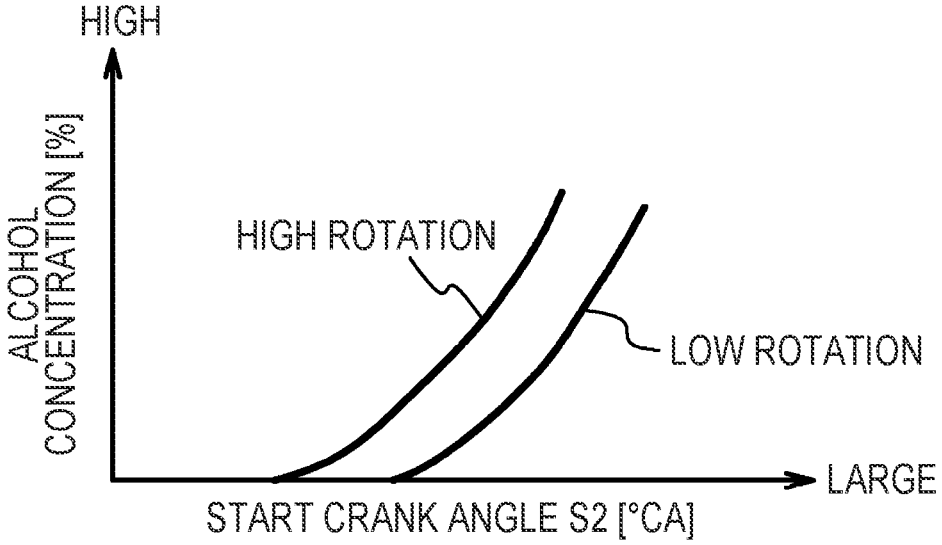
FIG. 9B is an example of a map in which the start crank angle S2 that is set depending on the alcohol concentration, the coolant temperature, and the engine rotation speed is defined.

FIGS. 9A and 9B are an example of a map in which the start crank angle S2 that is set depending on the alcohol concentration, the coolant temperature, and the engine rotation speed is defined. The vertical axis indicates the alcohol concentration [%], and the horizontal axis indicates the start crank angle S2 [° CA]. FIG. 9A shows a case where the temperature of the coolant is high and a case where the temperature of the coolant is low, and FIG. 9B shows a case where the engine rotation speed is high and a case where the engine rotation speed is low. As shown in FIGS. 9A and 9B, as the alcohol concentration is higher, as the temperature of the coolant is lower, and as the engine rotation speed is lower, the start crank angle S2 is set to be more retarded.

Figure 10A:
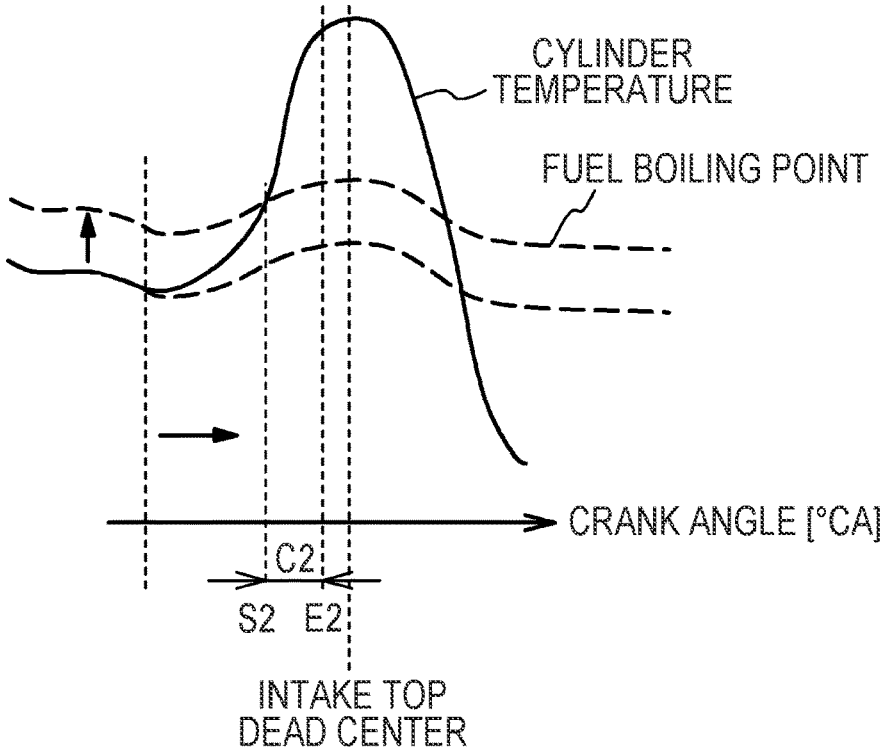
FIG. 10A is an illustrative view of change of the start crank angle S2 when the alcohol concentration is high.
Figure 10B:
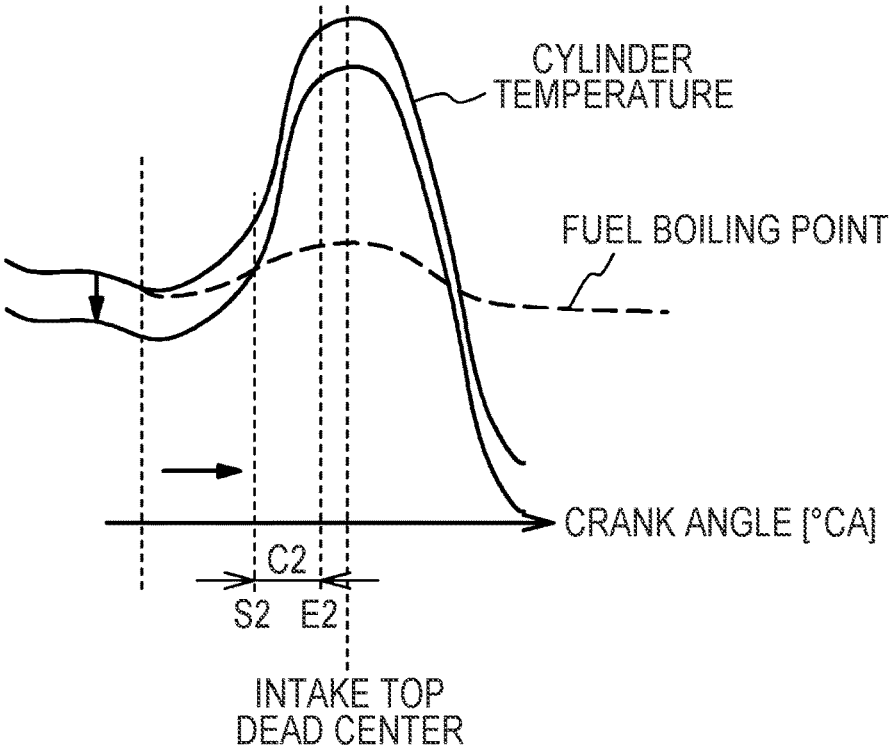
FIG. 10B is an illustrative view of change of the start crank angle S2 when the coolant temperature is low.

FIG. 10A is an illustrative view of change of the start crank angle S2 when the alcohol concentration is high. As the alcohol concentration in fuel is higher, the fuel boiling point is higher. For this reason, as shown in FIG. 10A, a timing at which the cylinder temperature exceeds the fuel boiling point is shifted to be retarded. FIG. 10B is an illustrative view of change of the start crank angle S2 when the temperature of the coolant is low. As the temperature of the coolant is lower, the cylinder temperature is lower. For this reason, as shown in FIG. 10B, a timing at which the cylinder temperature exceeds the fuel boiling point is shifted to be retarded. When the engine rotation speed is low, since an intake air amount introduced into the cylinder 12 also decreases, as the engine rotation speed is lower, the cylinder temperature is also lower. The reason is because, in this case, as shown in FIG. 10B, the timing at which the cylinder temperature exceeds the fuel boiling point is shifted to be retarded. From the above description, as the alcohol concentration is higher, as the coolant temperature is lower, and as the engine rotation speed is lower, the start crank angle S2 is calculated to be retarded. When cylinder injection is executed solely in the first crank angle section C1 and the second crank angle section C2, as the alcohol concentration is lower, the requested cylinder injection amount is smaller. For this reason, although it does not mean that, as the alcohol concentration is higher, the second crank angle section C2 is calculated to be shorter, as the coolant temperature is lower and as the engine rotation speed is lower, the second crank angle section C2 is calculated to be shorter.

In the maps of FIGS. 9A and 9B, although the start crank angle S2 changes in a curved shape with respect to the alcohol concentration, the disclosure is not limited thereto, and the start crank angle S2 may change in a linear shape or in a stepwise shape. The setting method of the start crank angle S2 described above is not limited as using the maps described above, the start crank angle S2 may be set based on an arithmetic expression with the alcohol concentration, the coolant temperature, and the engine rotation speed as arguments.

Next, the ECU 30 determines whether or not the requested cylinder injection section is less than a total period of the first crank angle section C1 and the second crank angle section C2 (Step S11). Step S11 is an example of processing that is executed by the second determination unit. When determination is made to be Yes in Step S11, the ECU 30 executes cylinder injection in both the first crank angle section C1 and the second crank angle section C2 (Step S12). Step S12 is an example of processing that is executed by the injection controller.

When determination is made to be No in Step S11, the ECU 30 executes cylinder injection in each of the first crank angle section C1, the second crank angle section C2, and the third crank angle section C3 (Step S13). The third crank angle section C3 is determined in advance by an experiment or the like, and is set to a crank angle section where fuel is difficult to be stuck to the top surface of the piston 13. Step S13 is an example of processing that is executed by the injection controller.

As described above, cylinder injection is not executed in the third crank angle section C3 as much as possible and cylinder injection is executed in the first crank angle section C1 and the second crank angle section C2 where the cylinder temperature exceeds the fuel boiling point, depending on the requested cylinder injection amount. With this, it is possible to promote vaporization of fuel to stabilize combustion.

In the above-described example, cylinder injection may be in at least one period of the first crank angle section C1, the second crank angle section C2, and the third crank angle section C3.

In the above-described example, although the valve closed period which includes the intake top dead center and during which both the intake valve 24 and the exhaust valve 25 are closed is secured by the intake VVT 26 and the exhaust VVT 27, the disclosure is not limited thereto. For example, when the intake VVT 26 is not provided and the exhaust VVT 27 is provided, a valve closed period may be secured in a period during which the exhaust VVT 27 is driven and the piston 13 is moving upward. Although the valve closed period does not need to always include the intake top dead center, when the intake top dead center is included in the valve closed period, it is preferable in that the cylinder temperature is the highest in the intake top dead center.

In the above-described, although the first crank angle section C1 and the second crank angle section C2 are calculated using the temperature of the coolant, a temperature of lubricating oil that lubricates the engine 10 may be used instead of the temperature of the coolant. The reason is because both the temperature of the coolant and the temperature of the lubricating oil are correlated to the temperature of the engine 10.

In the above-described example, although both the cylinder injection valve 17 and the port injection valve 22 are provided in the engine 10, the disclosure is not limited thereto, and an engine in which solely the cylinder injection valve 17 is provided may be employed. In the above-described example, although the internal combustion engine system 1 that is mounted in the vehicle has been described, the disclosure is not limited thereto. For example, the contents of the above-described example can also be applied to an internal combustion engine system, such as a motorcycle, a ship, or a construction machine, other than a vehicle.

Although the example of the disclosure has been described above in detail, the disclosure is not limited to such a specific example, and various modifications and alterations can be made within the scope of the gist of the disclosure described in the claims.

What is claimed is:

1. An internal combustion engine system comprising:

an internal combustion engine including a cylinder, an intake valve and an exhaust valve that open and close the cylinder, a cylinder injection valve that directly injects fuel containing alcohol into the cylinder, and a variable valve drive mechanism that forms a valve closed period from when the exhaust valve is closed to when the intake valve is opened; and a control device that controls the cylinder injection valve and the variable valve drive mechanism, wherein the control device includes a calculation unit that calculates a first crank angle section where a temperature of the cylinder is equal to or higher than a boiling point of the fuel in a compression stroke and a second crank angle section where the temperature of the cylinder is equal to or higher than the boiling point of the fuel in the valve closed period, before completion of warming-up of the internal combustion engine, and an injection controller that executes fuel injection in the first and second crank angle sections by the cylinder injection valve.

2. The internal combustion engine system according to claim 1, wherein:

the control device includes a first determination unit that determines whether or not the cylinder injection valve is able to inject a requested cylinder injection amount in the first crank angle section; and the injection controller executes the fuel injection in the first crank angle section by the cylinder injection valve when affirmative determination is made in the first determination unit and executes the fuel injection in the first and second crank angle sections by the cylinder injection valve when negative determination is made in the first determination unit.

3. The internal combustion engine system according to claim 2, wherein:

the control device includes a second determination unit that determines whether or not the cylinder injection valve is able to inject the requested cylinder injection amount in the first and second crank angle sections; and the injection controller executes the fuel injection in the first and second crank angle sections by the cylinder injection valve when negative determination is made in the first determination unit and affirmative determination is made in the second determination unit and executes the fuel injection in the first and second crank angle sections and an intake stroke by the cylinder injection valve when negative determination is made in the first and second determination units.

4. The internal combustion engine system according to claim 1, wherein:

the control device further includes an alcohol concentration acquisition unit that acquires an alcohol concentration in the fuel; and the calculation unit calculates a start crank angle of the first crank angle section to be more retarded as the alcohol concentration is higher.

5. The internal combustion engine system according to claim 4, wherein the calculation unit calculates a start crank angle of the second crank angle section to be more retarded as the alcohol concentration is higher.

6. The internal combustion engine system according to claim 1, wherein:

the control device further includes a temperature acquisition unit that acquires a temperature of the internal combustion engine; and the calculation unit calculates the first crank angle section to be shorter as the temperature is lower.

7. The internal combustion engine system according to claim 6, wherein the calculation unit calculates the second crank angle section to be shorter as the temperature is lower.

8. The internal combustion engine system according to claim 1, wherein:

the control device further includes a rotation speed acquisition unit that acquires a rotation speed of the internal combustion engine; and the calculation unit calculates the first crank angle section to be shorter as the rotation speed is lower.

9. The internal combustion engine system according to claim 8, wherein the calculation unit calculates the second crank angle section to be shorter as the rotation speed is lower.

10. The internal combustion engine system according to claim 1, wherein the valve closed period includes an intake top dead center.

11. The internal combustion engine system according to claim 1, wherein the calculation unit sets an end time of the first crank angle section to be more advanced than a compression top dead center.

12. The internal combustion engine system according to claim 1, wherein the calculation unit sets an end time of the second crank angle section to be more advanced than an intake top dead center.

* * * * *